US009375598B1

(12) United States Patent
Lai et al.

(10) Patent No.: US 9,375,598 B1
(45) Date of Patent: Jun. 28, 2016

(54) UPPER EXTREMITY REHABILITATION DEVICE

(71) Applicant: HIWIN TECHNOLOGIES CORP., Taichung (TW)

(72) Inventors: Wei-Fan Lai, Taichung (TW); Fu-Han Hsieh, Taichung (TW)

(73) Assignee: Hiwin Technologies Corp., Taichung (TW)

( * ) Notice: Subject to any disclaimer, the term of this patent is extended or adjusted under 35 U.S.C. 154(b) by 32 days.

(21) Appl. No.: 14/617,558

(22) Filed: Feb. 9, 2015

(51) Int. Cl.

| | |
|---|---|
| ***A63B 21/00*** | (2006.01) |
| ***A63B 15/02*** | (2006.01) |
| ***A63B 71/00*** | (2006.01) |
| ***A61H 1/00*** | (2006.01) |
| ***A61H 1/02*** | (2006.01) |
| ***A61H 5/00*** | (2006.01) |
| ***A63B 21/22*** | (2006.01) |
| ***A63B 23/12*** | (2006.01) |

(52) U.S. Cl.
CPC ..... *A63B 21/00181* (2013.01); *A63B 21/22* (2013.01); *A63B 21/4035* (2015.10); *A63B 22/0005* (2015.10); *A63B 23/12* (2013.01)

(58) Field of Classification Search
CPC ..... A63B 21/00178; A63B 21/00181; A63B 21/22; A63B 21/4019; A63B 21/4035; A63B 21/4045; A63B 21/4047; A63B 21/4049; A63B 22/0002; A63B 22/0005; A63B 23/12; A63B 23/1245; A63B 23/1254; A63B 23/1263; A63B 23/1272; A61H 1/0274; A61H 1/0277; A61H 1/0281
See application file for complete search history.

(56) References Cited

U.S. PATENT DOCUMENTS

2003/0028130 A1* 2/2003 Wunderly ..... A61H 1/0274 601/5
2014/0316308 A1* 10/2014 Lee ..... A63B 21/4043 601/33
2015/0360069 A1* 12/2015 Marti ..... A63B 21/00178 482/6

FOREIGN PATENT DOCUMENTS

TW 201306819 A1 2/2013

* cited by examiner

*Primary Examiner* — Oren Ginsberg
(74) *Attorney, Agent, or Firm* — Wang Law Firm, Inc.

(57) ABSTRACT

An upper extremity rehabilitation device includes: a base, a rotary shaft unit, a rotation drive unit, a brake unit, a linear move unit, a hand gripping assembly, a first and a second connecting rods. The rotary shaft unit is pivoted to the base. The rotation drive unit is disposed on the base and includes a drive portion connected to the first shaft portion. The brake unit includes an outer pipe disposed on the rotary shaft, and an inner pipe movably disposed in the outer pipe. The linear move unit includes a linear seat pivoted to the second shaft portion, and a linear platform movably disposed on the linear seat. The hand gripping assembly is disposed on the linear platform. The first connecting rod is pivoted to the brake unit. The second connecting rod is pivoted to the first connecting rod and the linear seat.

10 Claims, 17 Drawing Sheets

UPPER EXTREMITY REHABILITATION DEVICE

BACKGROUND OF THE INVENTION

1. Field of the Invention

The present invention relates to a rehabilitation device, and more particularly to an upper extremity rehabilitation device.

2. Description of the Prior Art

FIG. 1 shows an upper extremity rehabilitation device as disclosed in Taiwan Patent Application No. 100129108, which comprises: a base 11, a drive unit 12, a swing arm 13 and a swing-arm-travel setting unit 14. The drive unit 12 is disposed on the base 11. The swing arm 13 is coupled to and driven by the drive unit 12 to perform reciprocating motion, so as to make the patient's upper limbs swing reciprocatingly. In addition to moving the patient's upper limbs reciprocatingly, the drive unit 12 also provides a resistance force to the swing arm 13, which can increase the patient's muscular endurance through the repeated reciprocating motion of the upper limbs. The travel setting unit 14 is disposed at a lateral surface of the drive unit 12 and located between the swing arm 13 and the drive unit 12 to set the travel length of the swing arm 13.

However, the freedom of motion of the abovementioned rehabilitation device is limited due to the fact that the swing arm is only allowed to move in a single plane to move back and forth or left and right, or rotate forward or backward.

FIG. 2 shows another upper extremity rehabilitation device with more degrees of freedom of motion, which is designed in the form of a mechanical exoskeleton and comprises plural linearly moving units 16 each of which being driven to move by a drive member. Each of the joints 17 is provided with sensors 18 to detect the amplitude, speed, number (and etc) of the swing motion of the patient's upper limbs. However, excessive drive members and sensors 18 not only increase the manufacturing cost but also reduce the competitiveness of the rehabilitation device.

The present invention is aimed to mitigate and/or obviate the afore-described disadvantages.

SUMMARY OF THE INVENTION

The primary objective of the present invention is to provide an upper extremity rehabilitation device with lower manufacturing cost and higher competitiveness.

Another objective of the present invention is to provide an upper extremity rehabilitation device which provides more degrees of freedom or modes of rehabilitation.

To achieve the above objectives, an upper extremity rehabilitation device in accordance with the present invention comprises: a base; a rotary shaft unit pivoted to the base and including a first shaft portion and a second shaft portion; a rotation drive unit disposed on the base and including a drive portion connected to the first shaft portion; a brake unit including an outer pipe which is disposed on the rotary shaft, and an inner pipe which is movably disposed in the outer pipe and includes a connecting portion; a linear move unit including a linear seat pivoted to the second shaft portion, and a linear platform which is linearly movably disposed on the linear seat; a hand gripping assembly disposed on the linear platform; a first connecting rod including a first rod portion which is pivoted to the connecting portion, and a second rod portion; and a second connecting rod includes a third rod portion pivoted to the second rod portion, and a fourth rod portion pivoted to the linear seat.

Preferably, the first shaft portion is a toothed wheel, and the drive portion is a toothed wheel engaged with the first shaft portion.

Preferably, the rotary shaft unit further includes an extension portion disposed between the first and the second shaft portions, the outer pipe is fixed to the extension portion and includes a longitudinal drive member disposed in the outer pipe, and a brake screw driven to rotate by the longitudinal drive member, and the inner pipe is screwed on the brake screw.

Preferably, the linear move unit further includes a linear drive member disposed on the linear seat, a linear screw which is driven to rotate by the linear drive member, and a linear nut which is linearly movably screwed on the linear screw, and the linear platform is fixed to the linear nut.

Preferably, the hand gripping assembly includes a gripping seat which is fixed to the linear platform, a gripping handle which is replaceably disposed at the gripping seat, and a sensor.

Preferably, the rotary shaft unit further includes a rotary shaft outer pipe, a rotary shaft inner pipe movably disposed in the rotary shaft outer pipe, and a rotary member, the rotary shaft outer pipe is pivoted to the base and comprises the first shaft portion, the rotary shaft inner pipe includes the second shaft portion and a toothed bar, the rotary member is rotatably disposed in the rotary shaft outer pipe and includes a rotary head portion which is disposed outside the rotary shaft outer pipe, and a rotary toothed portion which is connected to the rotary head portion and disposed inside the rotary shaft outer pipe to engage with the toothed bar.

Preferably, the first shaft portion is a toothed wheel, and the drive portion is a toothed wheel engaged with the first shaft portion.

Preferably, the rotary shaft unit further comprises a rotary shaft inner pipe, a rotary shaft outer pipe movably sleeved onto the rotary shaft inner pipe, and an extensible brake, the rotary shaft inner pipe is pivoted to the base and includes the first shaft portion and an inner pipe extension portion, the rotary shaft outer pipe includes the second shaft portion and an outer pipe extension portion, the extensible brake is disposed between the inner pipe extension portion and the outer pipe extension portion and includes: an extensible brake outer pipe which is fixed to the inner pipe extension portion, and an extensible brake inner pipe which is movably disposed in the extensible brake outer pipe and connected to the outer pipe extension portion.

Preferably, the first shaft portion is a toothed wheel, and the drive portion is a toothed wheel engaged with the first shaft portion.

A method for using the upper extremity rehabilitation device in accordance with the present invention comprises the following steps: setting a path that the rotary shaft unit is driven to pivot on the rotation drive unit, a path that the inner pipe moves up and down with respect to the outer pipe, and a path that the linear platform moves left and right along the linear seat; gripping the hand gripping assembly with a patient's hand; and starting the upper extremity rehabilitation device and using it to move the patient's upper limbs along the paths set in the previous step.

DETAILED DESCRIPTION OF THE PREFERRED EMBODIMENTS

Figure 1:
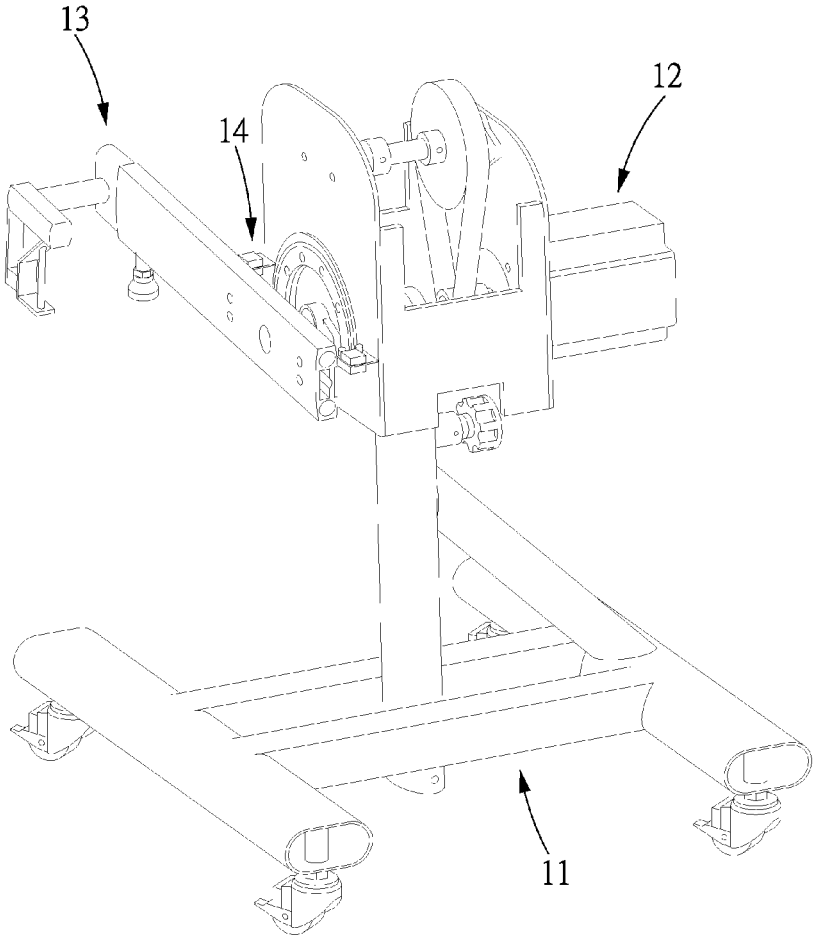
FIG.1 PRIOR ART
FIG. 1 is a perspective view of an upper extremity rehabilitation device as disclosed in Taiwan Patent Application No. 100129108.
Figure 2:
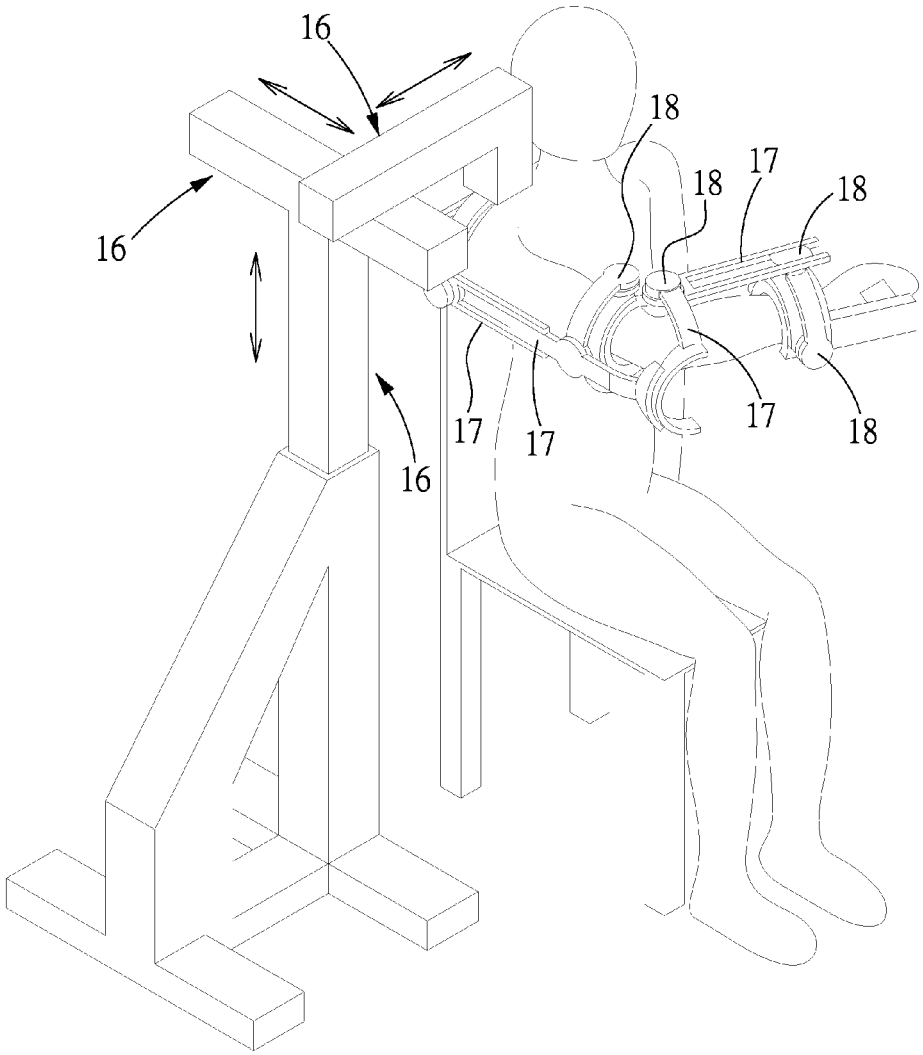
FIG.2 PRIOR ART
FIG. 2 shows another conventional upper extremity rehabilitation device with more degrees of freedom.
Figure 3:
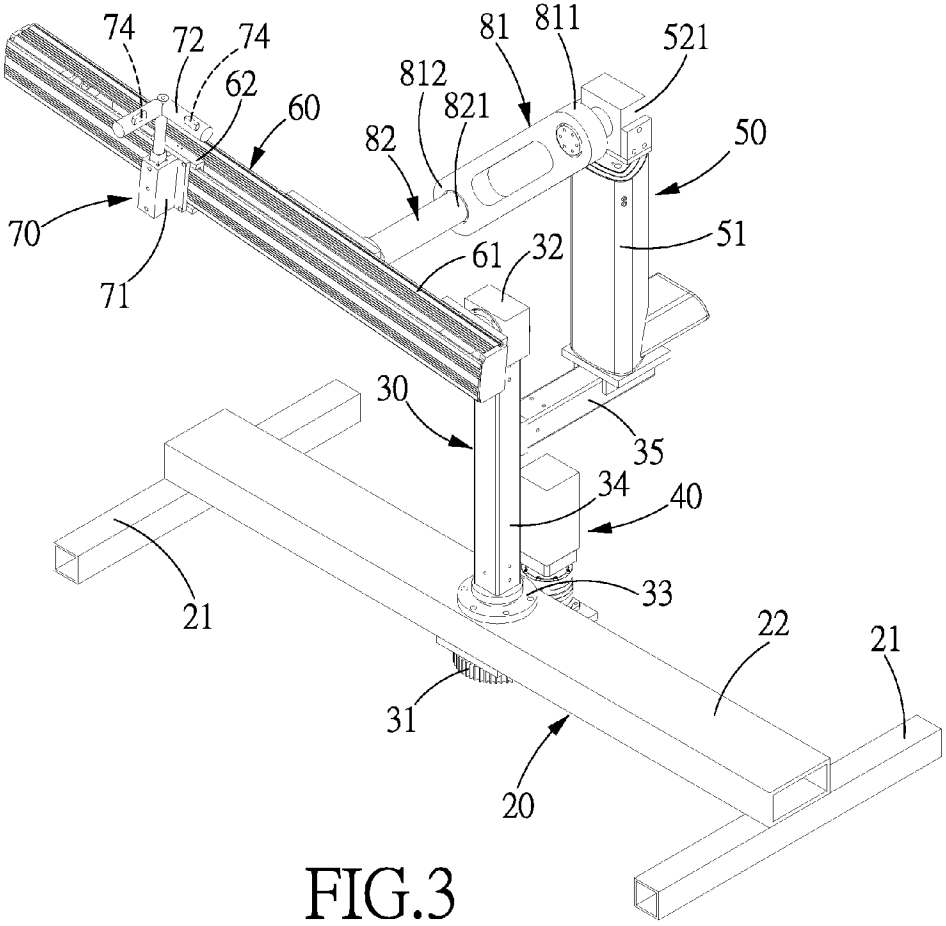
FIG. 3 is a perspective view of an upper extremity rehabilitation device in accordance with a first preferred embodiment of the present invention.
Figure 4:
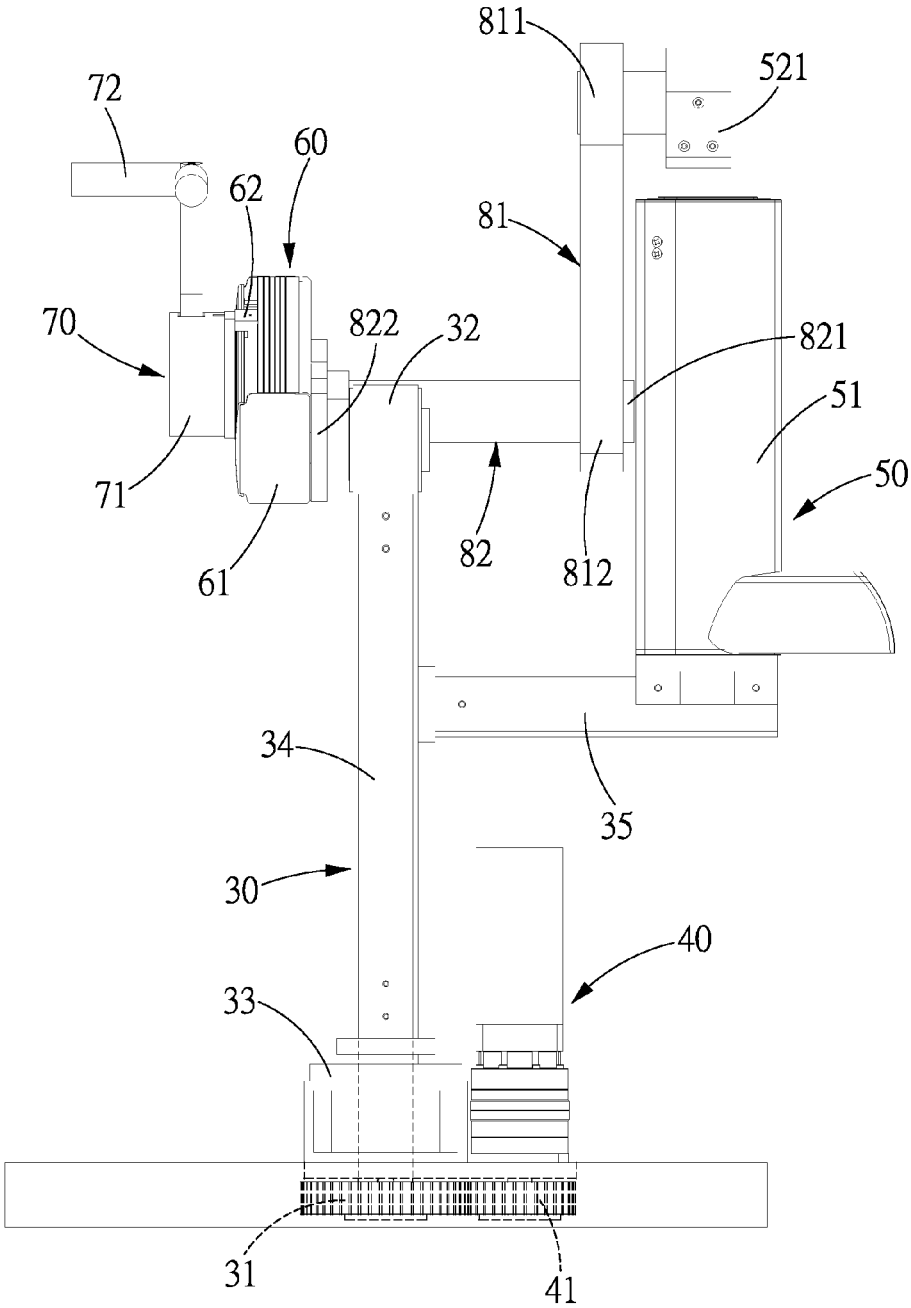
FIG. 4 is a side view of the upper extremity rehabilitation device in accordance with the first preferred embodiment of the present invention.

The present invention will be clearer from the following description when viewed together with the accompanying drawings, which show, for purpose of illustrations only, the preferred embodiment in accordance with the present invention.

Referring to FIGS. 3-7, an upper extremity rehabilitation device in accordance with a first preferred embodiment of the present invention comprises: a base 20, a rotary shaft unit 30, a rotation drive unit 40, a brake unit 50, a linear move unit 60, a hand gripping assembly 70, a first connecting rod 81 and a second connecting rod 82.

The base 20 includes two parallel first pipes 21 and a second pipe 22 which is connected between and longer than the first pipes 21.

The rotary shaft unit 30 is pivoted to the base 20 and includes a first shaft portion 31 and a second shaft portion 32. In this embodiment, the rotary shaft unit 30 includes a pivot seat 33 fixed to the second pipe 22, and a rotary shaft 34 longitudinally inserted through the pivot seat 33. The first shaft portion 31 is a toothed wheel disposed at a lower end of the rotary shaft 34 and located below the second pipe 22, and the second shaft portion 32 is an upper end of the rotary shaft 34. The rotary shaft unit 30 further includes an extension portion 35 which transversely extends between the first and second shaft portions 31, 32.

The rotation drive unit 40 is disposed on the second pipe 22 of the base 20 and includes a drive portion 41 connected to the first shaft portion 31. In this embodiment, the drive portion 41 is a toothed wheel which is directly engaged with the first shaft portion 31, or can be connected to the first shaft portion 31 via a belt pulley (not shown).

Figure 5:
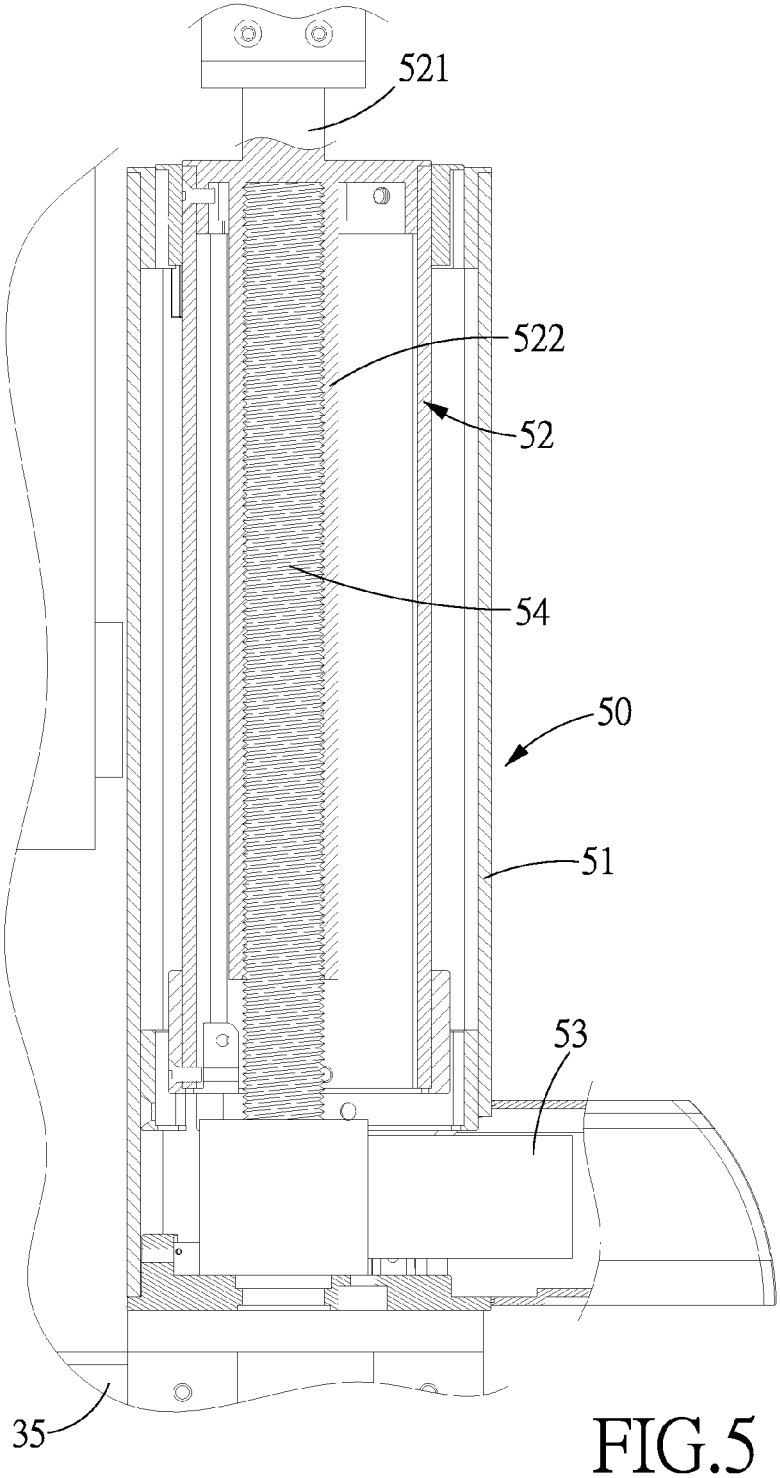
FIG. 5 is a cross sectional view of a part of FIG. 4.
Figure 6:
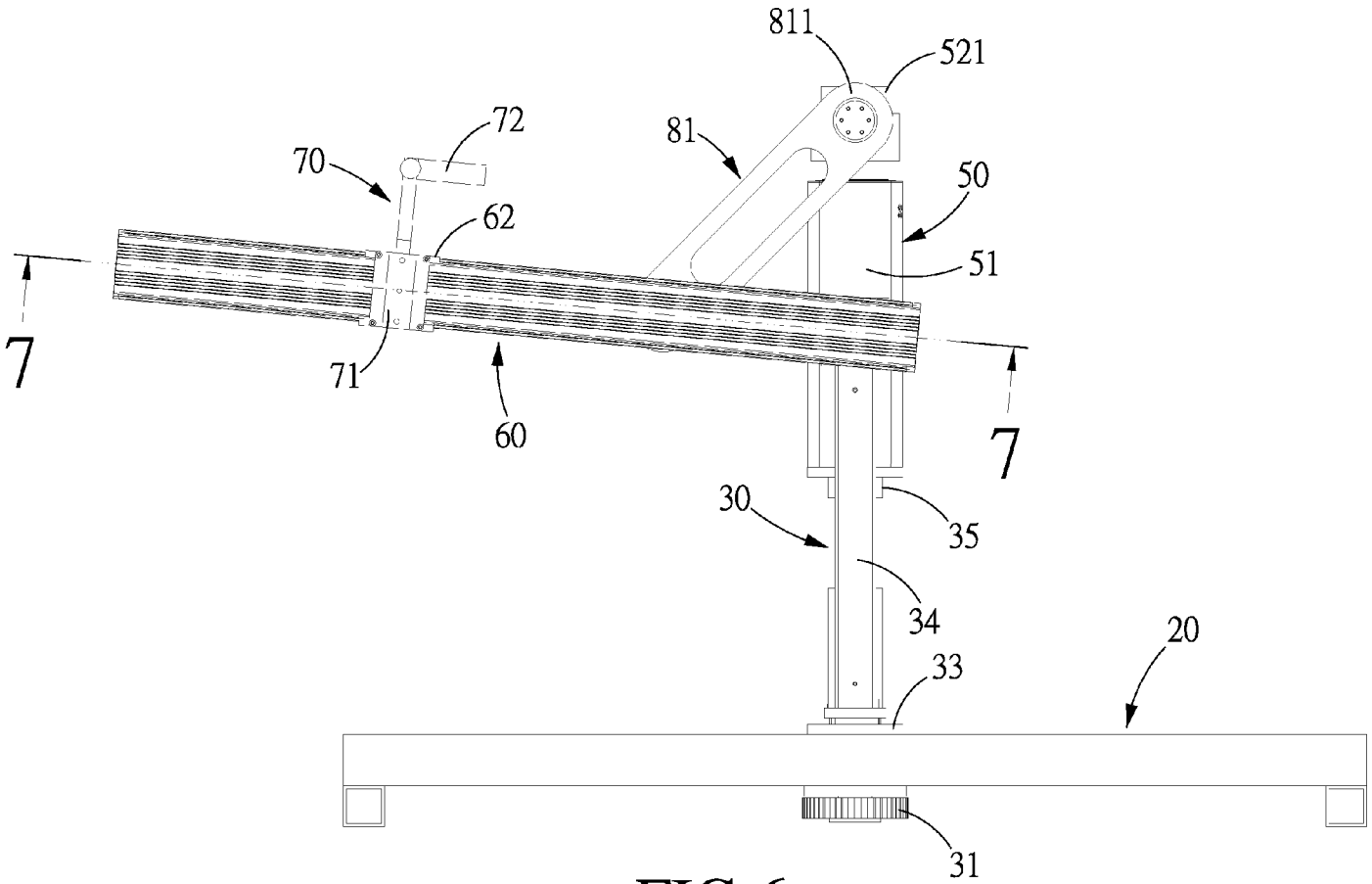
FIG. 6 is a front view of the upper extremity rehabilitation device in accordance with the first preferred embodiment of the present invention.

The brake unit 50 includes an outer pipe 51 which is disposed on the rotary shaft 34, and an inner pipe 52 which is movably disposed in the outer pipe 51 and includes a connecting portion 521. In this embodiment, as shown in FIG. 5, the outer pipe 51 is longitudinally fixed to the extension portion 35 and includes a longitudinal drive member 53 disposed in the outer pipe 51, and a brake screw 54 driven to rotate by the longitudinal drive member 53. The inner pipe 52 includes a sleeve portion 522 which is screwed on the brake screw 54. When the brake screw 54 is rotated by the longitudinal drive member 53, the inner pipe 52 will be caused to move reciprocatingly in the longitudinal direction.

Figure 7:
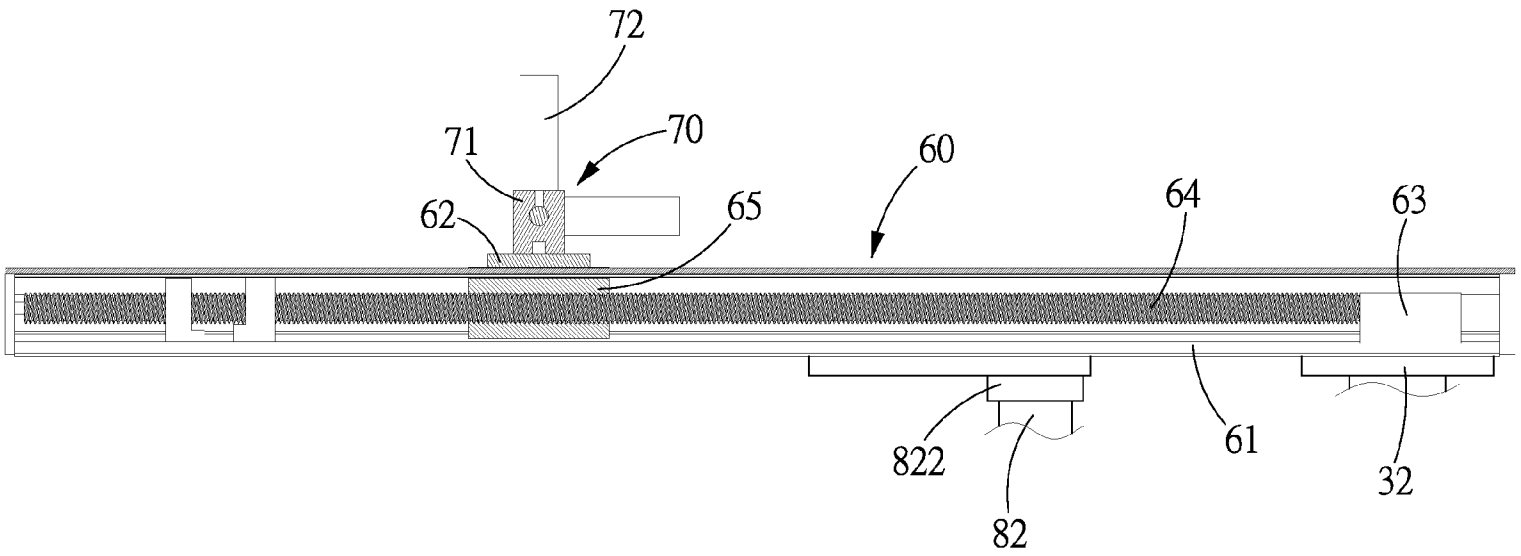
FIG. 7 is a cross sectional view taken along the line 7-7 of FIG. 6.

The linear move unit 60 includes a linear seat 61 pivoted to the second shaft portion 32, and a linear platform 62 which is linearly movably disposed on the linear seat 61. In this embodiment, as shown in FIG. 7, the linear move unit 60 further includes a linear drive member 63 disposed on the linear seat 61, a linear screw 64 which is driven to rotate by the linear drive member 63, and a linear nut 65 which is linearly movably screwed on the linear screw 64. The linear platform 62 is fixed to the linear nut 65. When the linear drive member 63 rotates the linear screw 64, the linear nut 65 will be caused to drive the linear platform 62 to move back and forth along the linear screw 64.

The hand gripping assembly 70 is disposed on the linear platform 62. In this embodiment, the hand gripping assembly 70 includes a gripping seat 71 which is fixed to the linear platform 62, a gripping handle 72 which is replaceably disposed at the gripping seat 71, and two sensors 74 (such as force sensors). In this embodiment, the sensors 74 are disposed inside the gripping handle 72 which is provided for the patient to grip.

The first connecting rod 81 includes a first rod portion 811 which is pivoted to the connecting portion 521 of the brake unit 50, and a second rod portion 812.

The second connecting rod 82 includes a third rod portion 821 pivoted to the second rod portion 812, and a fourth rod portion 822 pivoted to the linear seat 61.

Figure 8:
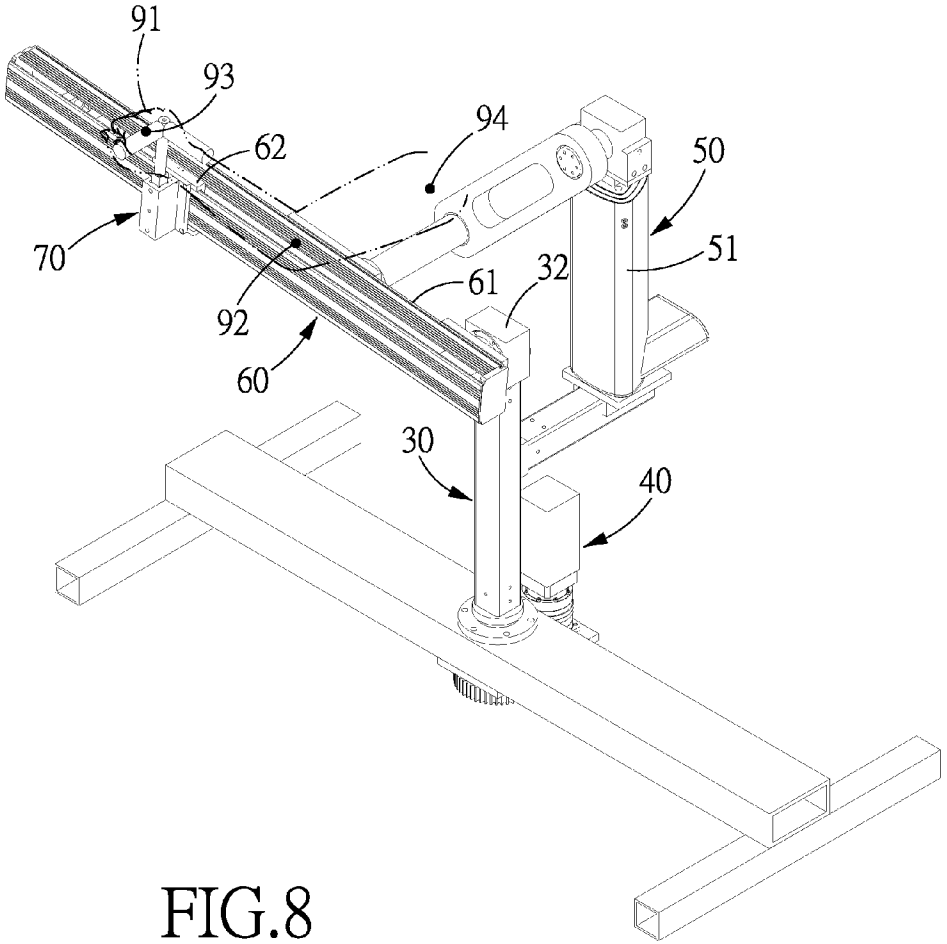
FIG. 8 is an operational view of the upper extremity rehabilitation device in accordance with the first preferred embodiment of the present invention, showing that the patient holds the hand gripping assembly with his/her hand.
Figure 9:
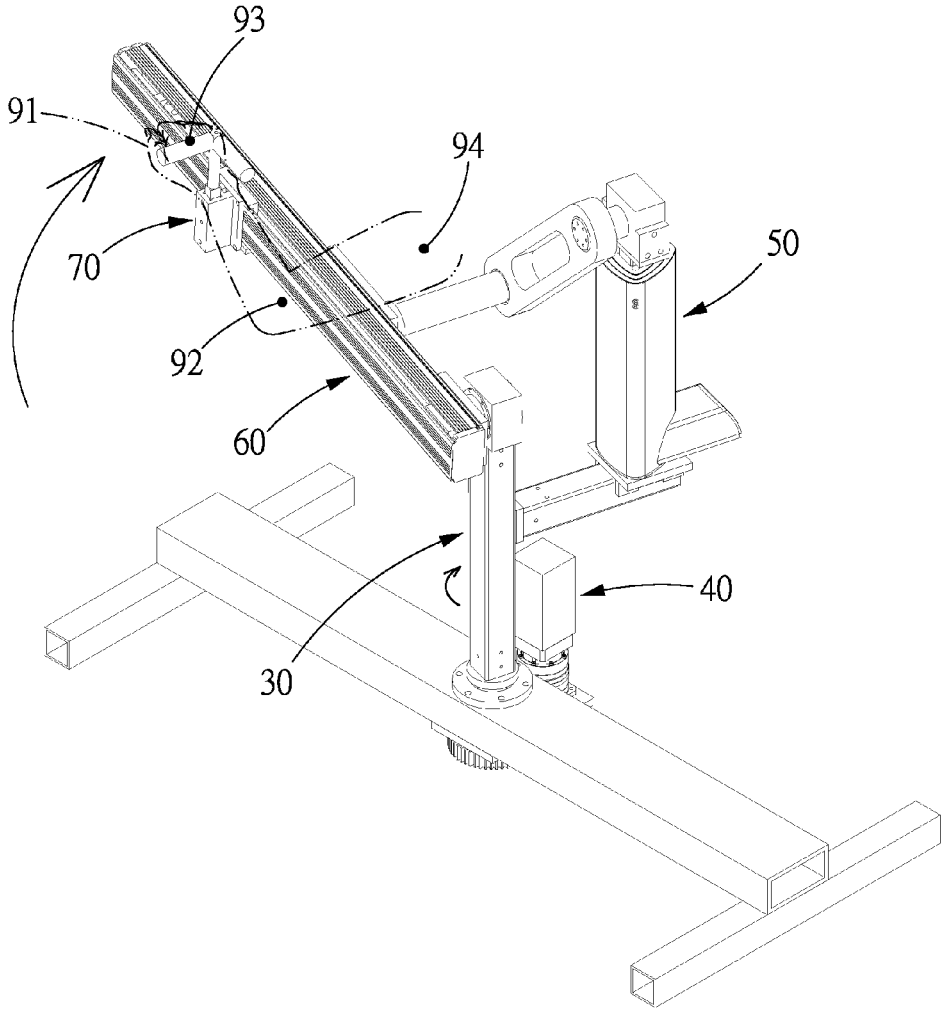
FIG. 9 is an operational view of the upper extremity rehabilitation device in accordance with the first preferred embodiment of the present invention, showing the first degree of freedom of the rehabilitation device.

What mentioned are the relations of the main components of the invention, and the upper extremity rehabilitation device of the first embodiment allows for three degrees of freedom of upper limbs rehabilitation, the details of which are explained below:

For the first degree of freedom of rehabilitation, please refer to FIGS. 8 and 9, when the hand 91 of the patient holds the hand gripping assembly 70, and the rotation drive unit 40 rotates the rotary shaft unit 30, the brake unit 50, the linear move unit 60 and the hand gripping assembly 70 disposed on the linear move unit 60 will swing an angle with respect to the rotary shaft unit 30. At his moment, the patient's hand will swing horizontally in a manner that the hand fulcrum 93 rotates about the elbow fulcrum 92 to move horizontally a distance toward or away from the shoulder fulcrum 94, thus achieve the first degree of freedom of horizontal motion of the upper limbs.

Figure 10:
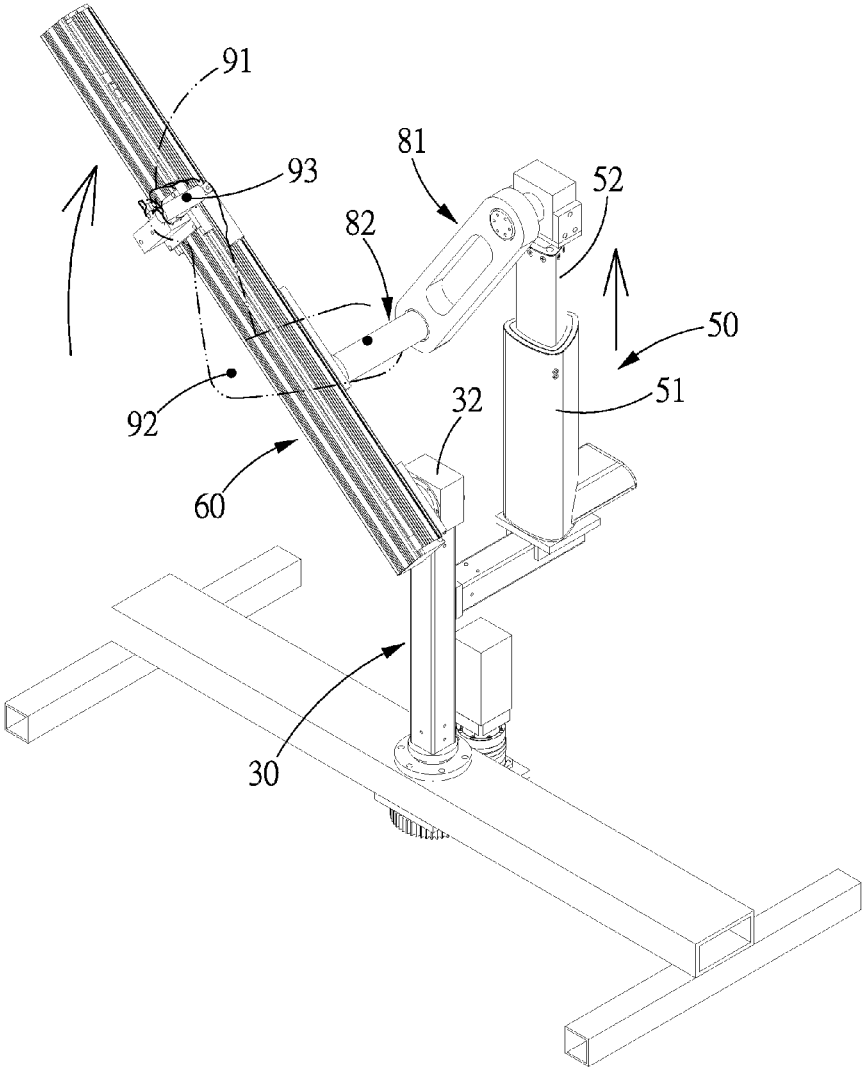
FIG. 10 is an operational view of the upper extremity rehabilitation device in accordance with the first preferred embodiment of the present invention, showing the second degree of freedom of the rehabilitation device.

The second degree of freedom of rehabilitation is shown in FIGS. 8 and 10, when the hand 91 of the patient holds the hand gripping assembly 70, and the brake unit 50 is actuated, the inner pipe 52 of the brake unit 50 will move up a distance with respect to the outer pipe 51, and will drive the linear move unit 60 via the first and second connecting rods 81, 82 to pivot an angle with respect to the second shaft portion 32 of the rotary shaft unit 30. At his moment, the patient's hand will swing vertically in a manner that the hand fulcrum 93 of the patient's hand rotates an angle about the elbow fulcrum 92 to move vertically up or down, thus achieve the second degree of freedom of vertical motion of the upper limbs.

Figure 11:
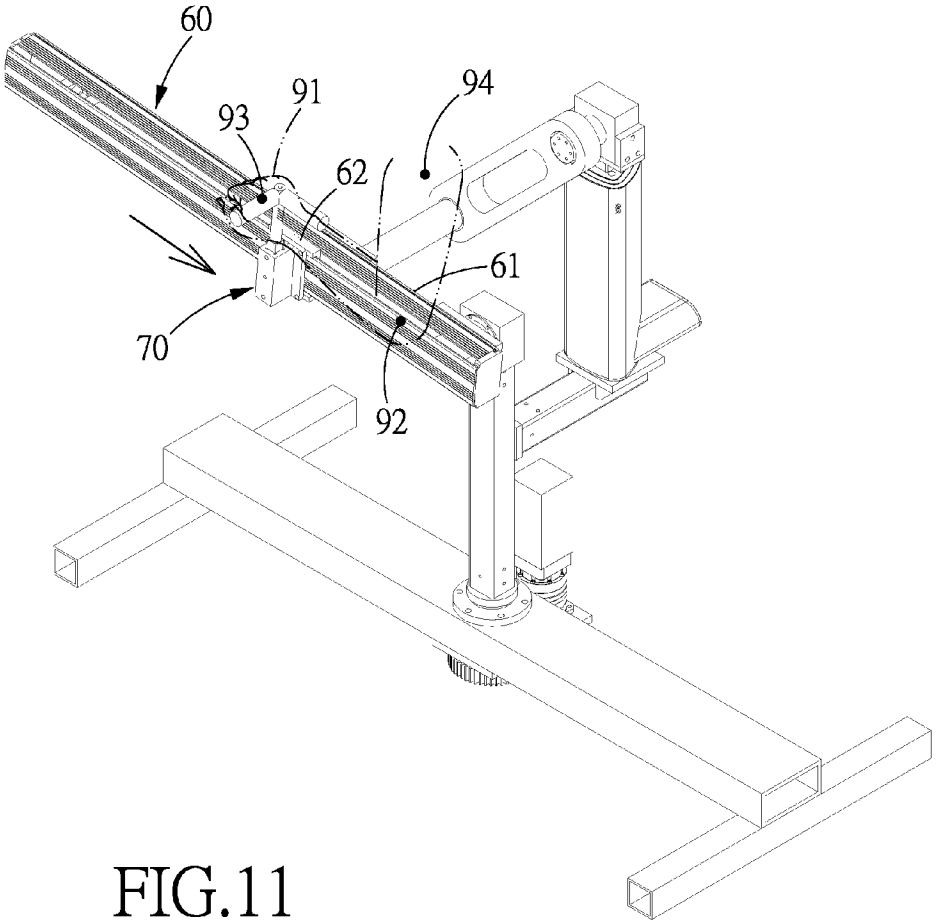
FIG. 11 is an operational view of the upper extremity rehabilitation device in accordance with the first preferred embodiment of the present invention, showing the third degree of freedom of the rehabilitation device.

The third degree of freedom of rehabilitation is shown in FIGS. 8 and 11, when the hand 91 of the patient holds the hand gripping assembly 70, and the linear move unit 60 is actuated, the linear platform 62 will push the hand gripping assembly 70 to move horizontally along the linear seat 61. At his moment, the patient's hand will swing horizontally in a manner that the hand fulcrum 93 and the elbow fulcrum 92 of the patient's limb move horizontally back and forth a distance with respect to the shoulder fulcrum 94, thus achieve the third degree of freedom of horizontal motion of the upper limbs.

Figure 17:
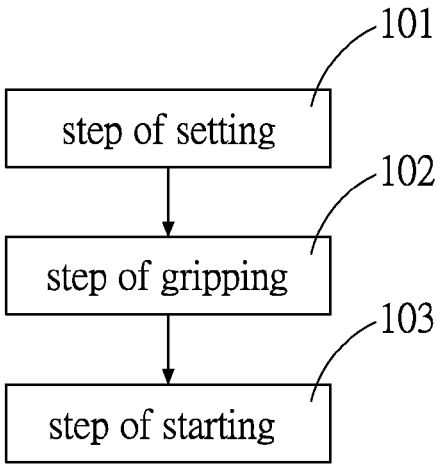
FIG. 17 is a flow chart of a method for using the upper extremity rehabilitation device in accordance with the present invention.

In real application, as shown in FIG. 17, the method for using the upper extremity rehabilitation device in accordance with the present invention comprises the following steps: a step 101 of setting, a step 102 of gripping, and a step 103 of starting.

The step 101 of setting includes setting the path that the rotary shaft unit 30 is driven to pivot by the rotation drive unit 40, the path that the inner pipe 52 moves up and down with respect to the outer pipe 51, and the path that the linear platform 62 moves left and right along the linear seat 61.

The step 102 of gripping includes gripping the hand gripping assembly 70 with the patient's hand 91.

The step 103 of starting includes starting (turning on) the upper extremity rehabilitation device and using it to move the patient's upper limbs along the paths set in the previous step to perform a single degree of freedom or several degrees of freedom of rehabilitation.

It can be learned from the above description that the upper extremity rehabilitation device in accordance with the present invention comprises: the base 20, the rotary shaft unit 30, the rotation drive unit 40, the brake unit 50, the linear move unit 60, the hand gripping assembly 70, the first connecting rod 81 and the second connecting rod 82, and is capable of performing several degrees of freedom of rehabilitation with less drive members. Hence, the present invention reduces the manufacturing cost, improves competitive power and provides various different rehabilitation modes.

Besides, the sensors 74 of the hand gripping assembly 70 can real-time detect the force that the patient's muscle exerts during the rehabilitation process, and provide feedback to the back-end database to record and analyze the rehabilitation.

Figure 12:
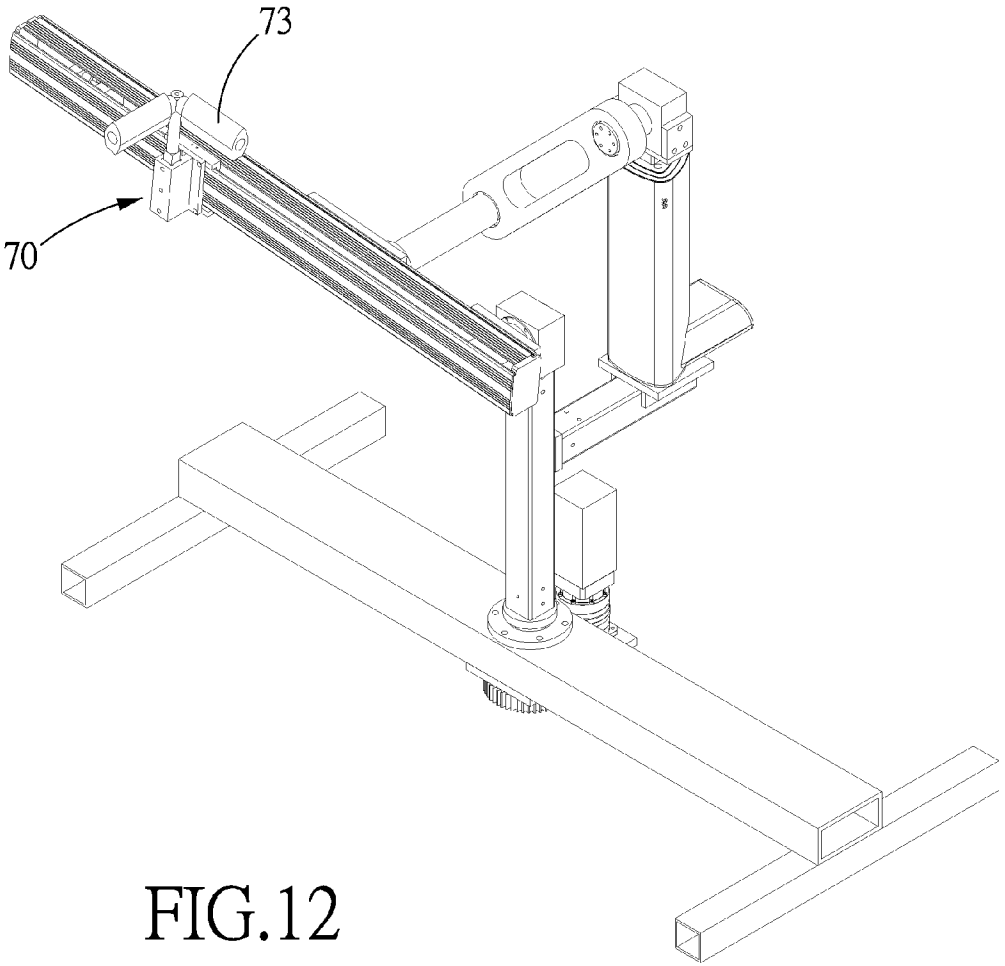
FIG. 12 is a perspective view of the upper extremity rehabilitation device in accordance with the first preferred embodiment of the present invention, showing that the patient holds the hand gripping assembly with his/her hand.

Referring to FIG. 12, the gripping handle 73 of the hand gripping assembly 70 can be replaced according to the size of different patient's hands.

Figure 13:
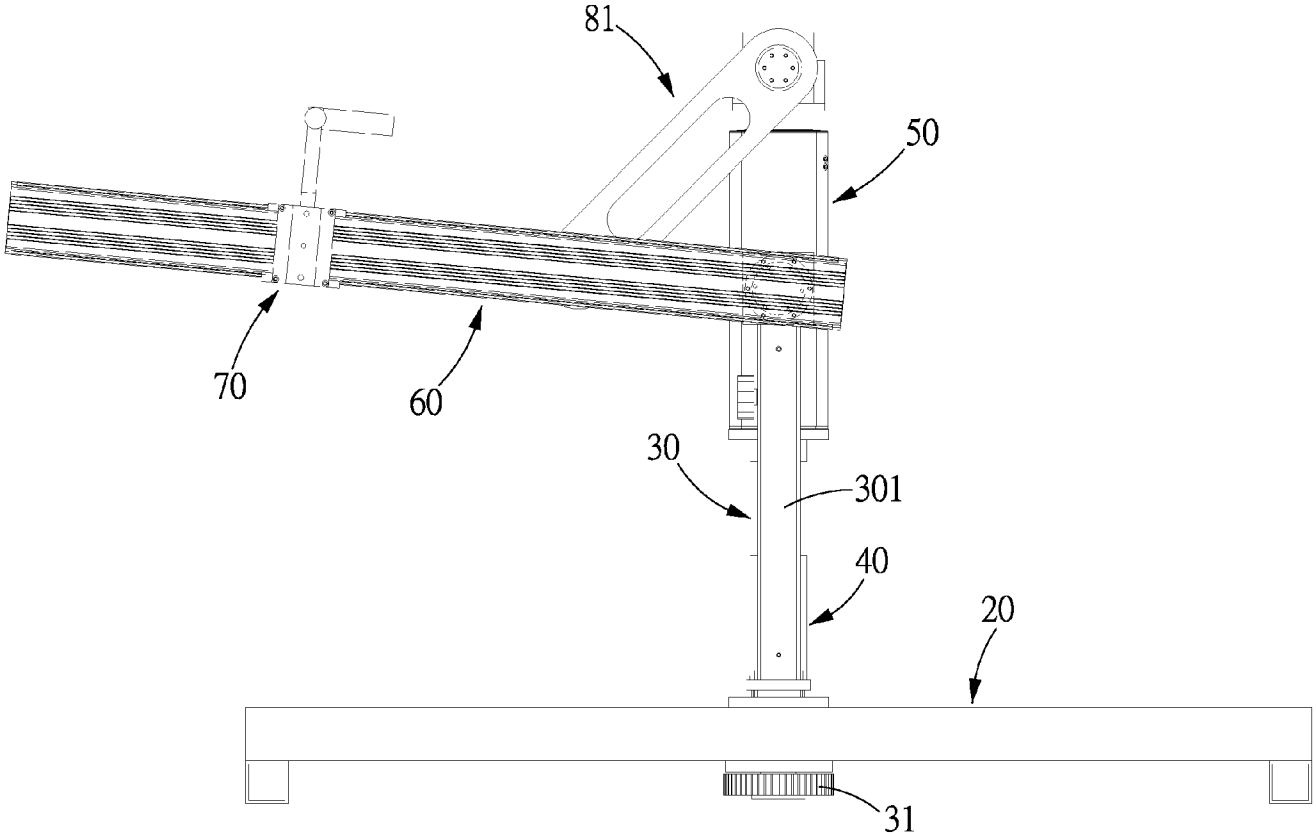
FIG. 13 is a front view of the upper extremity rehabilitation device in accordance with a second preferred embodiment of the present invention.
Figure 14:
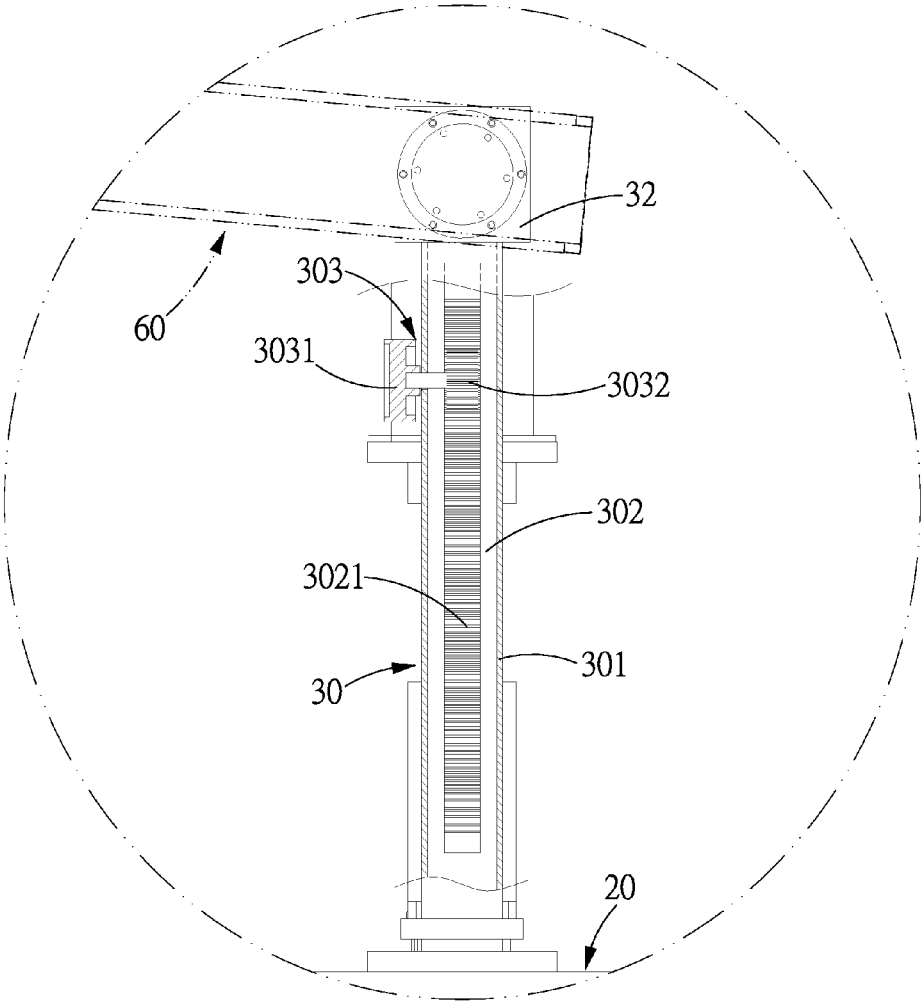
FIG. 14 is a cross sectional view of a part of FIG. 13.
Figure 15:
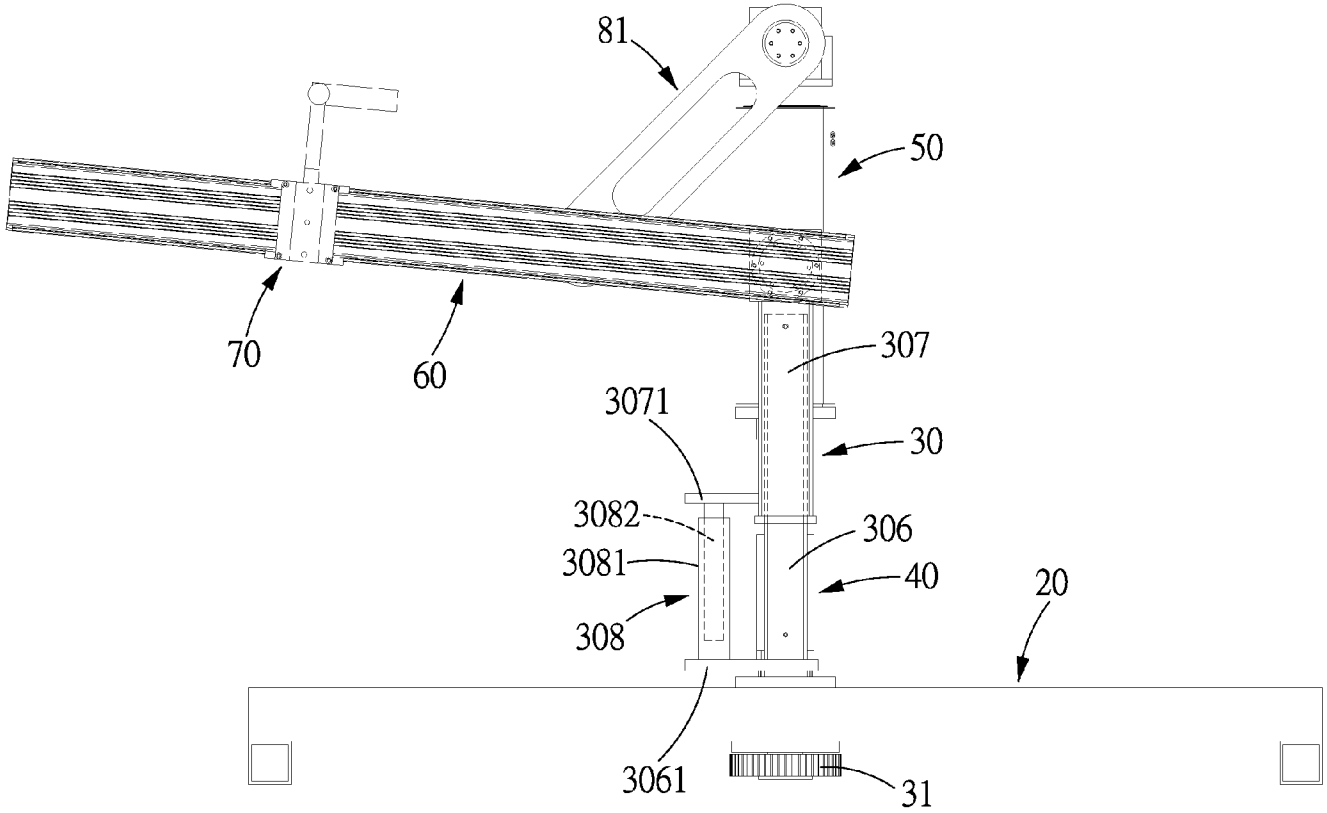
FIG. 15 is a front view of the upper extremity rehabilitation device in accordance with a third preferred embodiment of the present invention.
Figure 16:
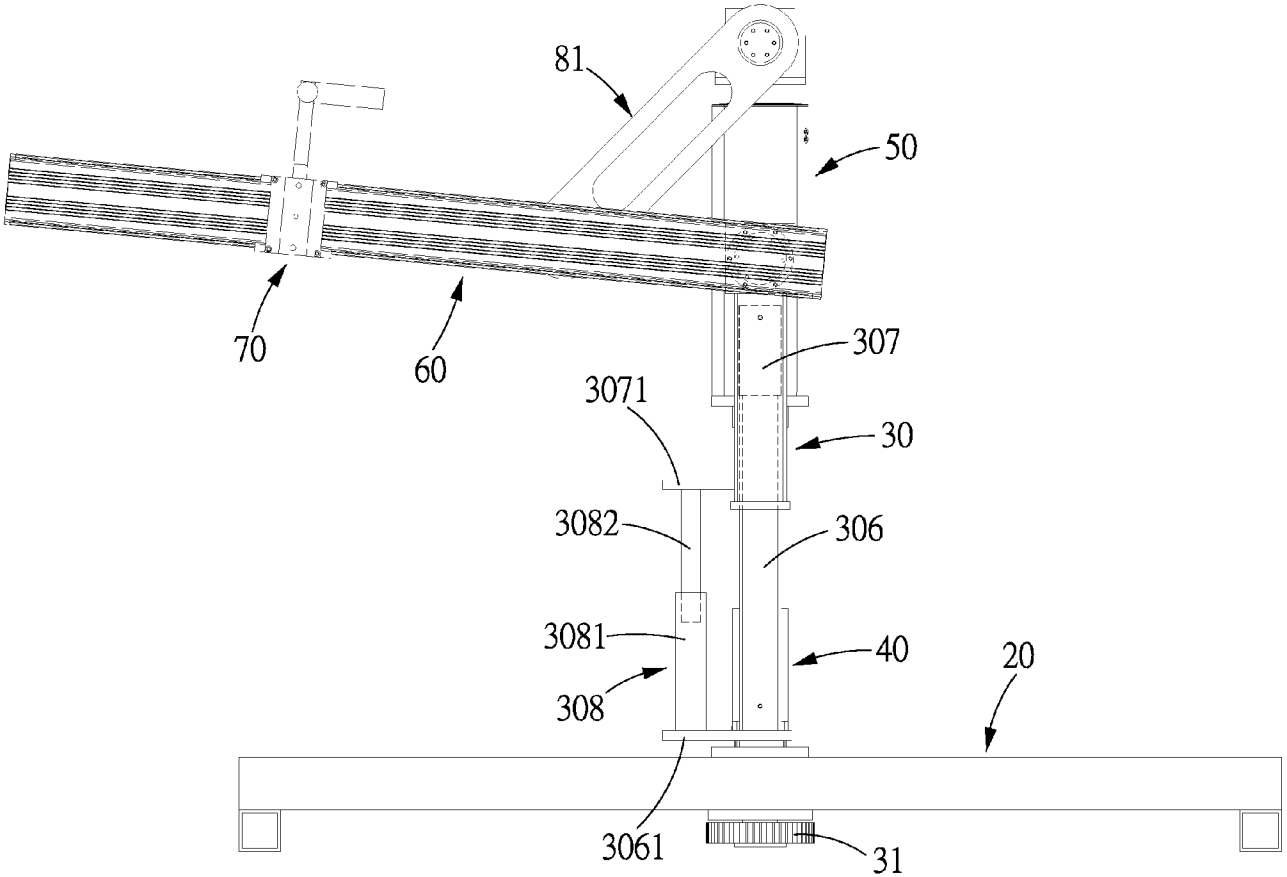
FIG. 16 is an operational view of the upper extremity rehabilitation device in accordance with the third preferred embodiment of the present invention.

Referring to FIGS. 13 and 14, an upper extremity rehabilitation device in accordance with a second preferred embodiment of the present invention is similar to the first embodiment, except that: the rotary shaft unit 30 further includes a rotary shaft outer pipe 301, a rotary shaft inner pipe 302 movably disposed in the rotary shaft outer pipe 301, and a rotary member 303. The rotary shaft outer pipe 301 is pivoted to the base 20 and comprises the first shaft portion 31. The rotary shaft inner pipe 302 includes the second shaft portion 32 and a toothed bar 3021. The rotary member 303 is rotatably disposed in the rotary shaft outer pipe 301 and includes a rotary head portion 3031 which is disposed outside the rotary shaft outer pipe 301, and a rotary toothed portion 3032 which is connected to the rotary head portion 3031 and disposed inside the rotary shaft outer pipe 301 to engage with the toothed bar 3021.

Rotating the rotary member 303 can make the rotary shaft inner pipe 302 to move longitudinally up or down with respect to the rotary shaft outer pipe 301, so as to adjust the height of the linear move unit 60 to fit the patient, or provide an additional height freedom of rehabilitation.

Referring to FIGS. 13 and 14, an upper extremity rehabilitation device in accordance with a third preferred embodiment of the present invention is similar to the first embodiment, except that: the rotary shaft unit 30 further comprises a rotary shaft inner pipe 306, a rotary shaft outer pipe 307 movably sleeved onto the rotary shaft inner pipe 306, and an extensible brake 308. The rotary shaft inner pipe 306 is pivoted to the base 20 and includes the first shaft portion 31 and an inner pipe extension portion 3061. The rotary shaft outer pipe 307 includes the second shaft portion 32 and an outer pipe extension portion 3071. The extensible brake 308 is disposed between the inner pipe extension portion 3061 and the outer pipe extension portion 3071 and includes: an extensible brake outer pipe 3081 which is fixed to the inner pipe extension portion 3061, and an extensible brake inner pipe 3082 which is movably disposed in the extensible brake outer pipe 3081 and connected to the outer pipe extension portion 3071.

Controlling the extensible brake 38 can make the rotary shaft outer pipe 307 move longitudinally up or down with respect to the rotary shaft inner pipe 306, so as to adjust the height of the linear move unit 60 to fit the patient, or provide an additional height freedom of rehabilitation.

While we have shown and described various embodiments in accordance with the present invention, it is clear to those skilled in the art that further embodiments may be made without departing from the scope of the present invention.

What is claimed is:

1. An upper extremity rehabilitation device comprising:

a base;

a rotary shaft unit pivoted to the base and including a first shaft portion and a second shaft portion;

a rotation drive unit disposed on the base and including a drive portion connected to the first shaft portion;

a brake unit including an outer pipe which is disposed on the rotary shaft, and an inner pipe which is movably disposed in the outer pipe and includes a connecting portion;

a linear move unit including a linear seat pivoted to the second shaft portion, and a linear platform which is linearly movably disposed on the linear seat;

a hand gripping assembly disposed on the linear platform;

a first connecting rod including a first rod portion which is pivoted to the connecting portion, and a second rod portion; and a second connecting rod includes a third rod portion pivoted to the second rod portion, and a fourth rod portion pivoted to the linear seat.

2. The upper extremity rehabilitation device as claimed in claim 1, wherein the first shaft portion is a toothed wheel, and the drive portion is a toothed wheel engaged with the first shaft portion.

3. The upper extremity rehabilitation device as claimed in claim 1, wherein the rotary shaft unit further includes an extension portion disposed between the first and second shaft portions, the outer pipe is fixed to the extension portion and includes a longitudinal drive member disposed in the outer pipe, and a brake screw driven to rotate by the longitudinal drive member, and the inner pipe is screwed on the brake screw.

4. The upper extremity rehabilitation device as claimed in claim 1, wherein the linear move unit further includes a linear drive member disposed on the linear seat, a linear screw which is driven to rotate by the linear drive member, and a linear nut which is linearly movably screwed on the linear screw, and the linear platform is fixed to the linear nut.

5. The upper extremity rehabilitation device as claimed in claim 1, wherein the hand gripping assembly includes a gripping seat which is fixed to the linear platform, a gripping handle which is replaceably disposed at the gripping seat, and a sensor.

6. The upper extremity rehabilitation device as claimed in claim 1, wherein the rotary shaft unit further includes a rotary shaft outer pipe, a rotary shaft inner pipe movably disposed in the rotary shaft outer pipe, and a rotary member, the rotary shaft outer pipe is pivoted to the base and comprises the first shaft portion, the rotary shaft inner pipe includes the second shaft portion and a toothed bar, the rotary member is rotatably disposed in the rotary shaft outer pipe and includes a rotary head portion which is disposed outside the rotary shaft outer pipe, and a rotary toothed portion which is connected to the rotary head portion and disposed inside the rotary shaft outer pipe to engage with the toothed bar.

7. The upper extremity rehabilitation device as claimed in claim 6, wherein the first shaft portion is a toothed wheel, and the drive portion is a toothed wheel engaged with the first shaft portion.

8. The upper extremity rehabilitation device as claimed in claim 1, wherein the rotary shaft unit further comprises a rotary shaft inner pipe, a rotary shaft outer pipe movably sleeved onto the rotary shaft inner pipe, and an extensible brake, the rotary shaft inner pipe is pivoted to the base and includes the first shaft portion and an inner pipe extension portion, the rotary shaft outer pipe includes the second shaft portion and an outer pipe extension portion, the extensible brake is disposed between the inner pipe extension portion and the outer pipe extension portion and includes: an extensible brake outer pipe which is fixed to the inner pipe extension portion, and an extensible brake inner pipe which is movably disposed in the extensible brake outer pipe and connected to the outer pipe extension portion.

9. The upper extremity rehabilitation device as claimed in claim 8, wherein the first shaft portion is a toothed wheel, and the drive portion is a toothed wheel engaged with the first shaft portion.

10. A method for using the upper extremity rehabilitation device as claimed in claim 1 comprising the following steps:

setting a path that the rotary shaft unit is driven to pivot by the rotation drive unit, a path that the inner pipe moves up and down with respect to the outer pipe, and a path that the linear platform moves left and right along the linear seat;

gripping the hand gripping assembly with a patient's hand; and starting the upper extremity rehabilitation device and using it to move the patient's upper limbs along the paths set in the previous step.

* * * * *